US005673997A

United States Patent [19]

Akiyama

[11] Patent Number: 5,673,997

[45] Date of Patent: Oct. 7, 1997

[54] TRIM SUPPORT FOR RECESSED LIGHTING FIXTURE

[75] Inventor: Steven Randall Akiyama, Park Forest, Ill.

[73] Assignee: Cooper Industries, Inc., Houston, Tex.

[21] Appl. No.: 646,101

[22] Filed: May 7, 1996

[51] Int. Cl.[6] ..... F21S 1/02

[52] U.S. Cl. ..... 362/147; 362/365; 362/366

[58] Field of Search ..... 362/364, 365, 362/366, 147, 148

[56] References Cited

U.S. PATENT DOCUMENTS 1,987,705 1/1935 Pedersen ..... 362/364
3,099,404 7/1963 Kaufman et al. ..... 362/366
4,760,510 7/1988 Lahti ..... 362/365
4,829,410 5/1989 Patel ..... 362/365

*Primary Examiner*—Carroll B. Dority
*Attorney, Agent, or Firm*—Burns, Doane, Swecker & Mathis, L.L.P.

[57] ABSTRACT

A trim for a recessed lighting fixture includes an upper reflector piece and a lower baffle piece. The reflector piece has a top wall for supporting a lamp socket. The baffle piece includes a trim ring at its lower end. A lower end of the reflector piece, and an upper end of the baffle piece include respective flanges projecting laterally outwardly. Those flanges are held together by spring clips which also carry torsion springs for connecting the trim to a housing. Each spring clip includes a pair of vertically spaced spring legs for clamping the flanges therebetween, and a downwardly projecting carrier portion for carrying a torsion spring.

15 Claims, 2 Drawing Sheets

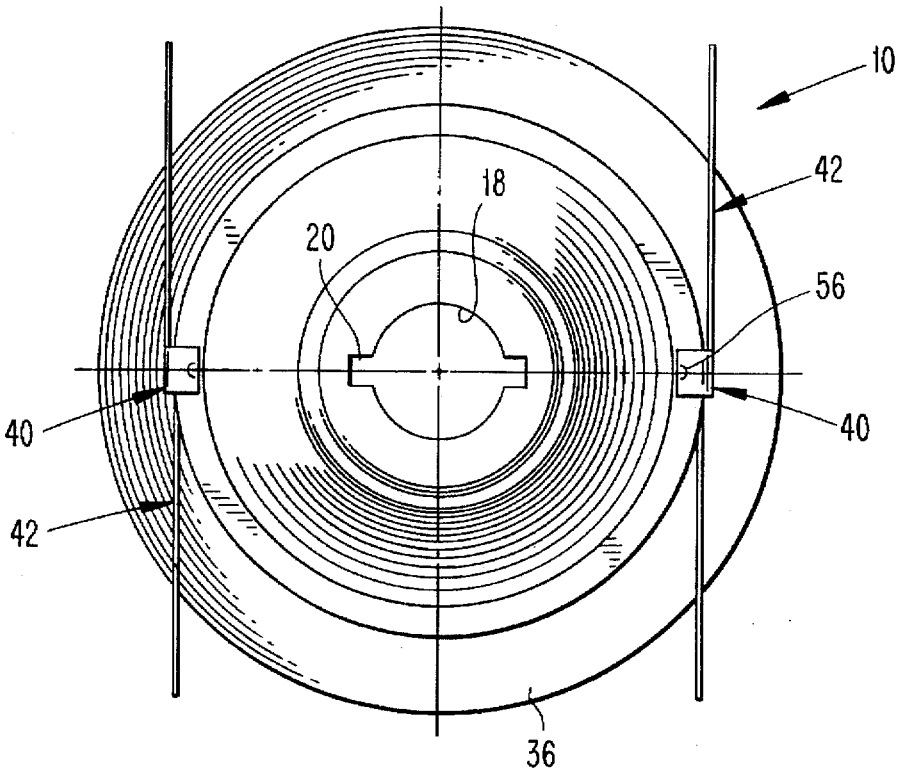
FIG. 3
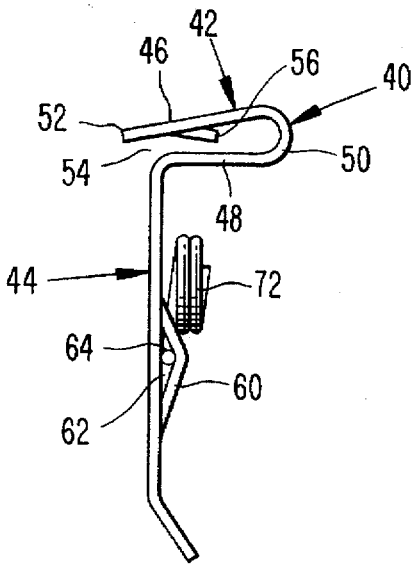
FIG. 4
FIG. 5
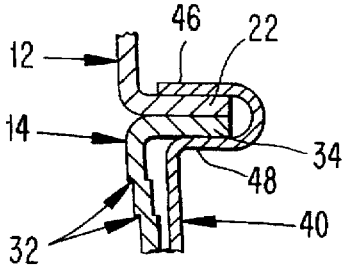
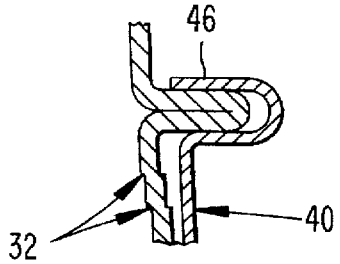
FIG. 6

TRIM SUPPORT FOR RECESSED LIGHTING FIXTURE

BACKGROUND OF THE INVENTION

The present invention relates to recessed light fixtures and, in particular, to a trim for such fixtures.

Recessed light fixtures typically include a housing affixed to a ceiling structure, a trim mounted to the housing and disposed within a hole formed in the ceiling, and a lamp socket attached to the housing or trim.

One standard type of trim forms an upper reflector portion and a lower non-reflective baffle portion, with a lower edge of the baffle portion being bent to form a laterally outwardly extending trim ring. A lamp socket is mounted on the top of the reflector portion.

The reflector and baffle portions can comprise parts of a single trim piece, or can comprise separate parts that are joined together.

When the fixture is installed in a ceiling, the trim ring lies below the ceiling surface for covering the edge of the hole formed in the ceiling to accommodate the fixture.

Among the known devices for joining a trim to a housing are coil springs, friction springs, and torsion springs. Coil springs are often used to mount trims of the type that are open at the top.

However, in trims that are closed at the top, it is too difficult to mount the coil spring. Hence, in those cases, torsion springs are preferred because they are not dependent on the housing being mounted in a rigid immovable manner to the ceiling structure in order to create a light-tight engagement of the trim ring against the ceiling. That is, the torsion springs compress the ceiling material between the housing plaster frame and the trim ring regardless of how firmly the housing is attached to the bar hangers and ceiling joist.

The mounting of torsion springs to the trim has been achieved by means of fasteners, e.g. rivets or screws. However, inner ends of the rivets and screws are visible on the inner surface of the trim, thereby detracting from the aesthetic appearance of the trim.

Furthermore, in cases where the trim comprises separate reflector and baffle parts, it is necessary to fasten those parts together. Again, if rivets or screws are used, inner ends of those fasteners can be visible on the inner surface of the reflector. Even if spot welding is employed, the spot welding equipment can produce visible deformations in the inner surface of the trim.

Therefore, it would be desirable to enable a torsion spring to be mounted to a multi-piece or single-piece trim without diminishing the aesthetic appearance of an inner surface of the trim.

It would also be desirable to enable the reflector and baffle portions of a two-piece trim to be interconnected without diminishing the aesthetic appearance of the inner surface of the trim.

SUMMARY OF THE INVENTION

The present invention relates to a trim for a recessed light fixture. The trim includes an outwardly projecting flange structure which can be used to attach torsion springs to the trim, or to interconnect the upper and lower trim pieces of a multi-piece trim.

Preferably, the trim comprises an upper trim piece including a laterally outwardly projecting first flange at its lower end, and a lower trim piece including a laterally outwardly projecting second flange at its upper end. The lower trim also includes a laterally outwardly projecting trim ring at its lower end. An upper surface of the second flange contacts a lower surface of the first flange. A plurality of spring clips interconnect the first and second flanges. Each spring clip includes a clamping portion for clamping the first and second flanges together, and a carrier portion. A torsion spring is connected to the carrier portion of each spring clip.

The clamping portion preferably comprises vertically spaced upper and lower horizontal clamping legs joined by a bight to be elastically movable away from one another for receiving the first and second flanges therebetween and clamping those flanges together.

The carrier portion preferably extends downwardly from an end of the lower clamping leg disposed opposite the bight.

One of the clamping legs preferably includes a barb for engaging a respective flange.

BRIEF DESCRIPTION OF THE DRAWINGS

The objects and advantages of the invention will become apparent from the following detailed description of a preferred embodiment thereof in connection with the accompanying drawing in which like numerals designate like elements and in which:

FIG. 3 is a top plan view of the trim depicted in FIG. 2;

FIG. 4 is a side elevational view of a spring clip according to the present invention;

FIG. 5 is a fragmentary vertical sectional view through an upper portion of a spring clip which is clamping together two flanges of the trim body; and FIG. 6 is a view similar to FIG. 5 of a one-piece trim having an outwardly projecting flange structure to which a torsion spring-carrying clip can be mounted.

DETAILED DESCRIPTION OF PREFERRED EMBODIMENTS OF THE INVENTION

Figure 1:
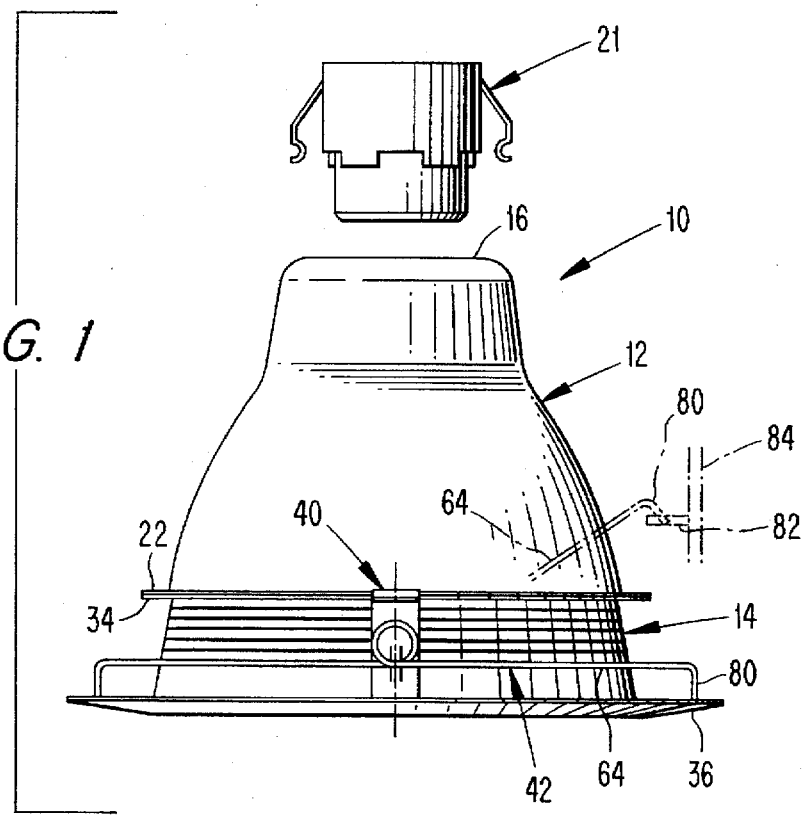
FIG. 1 is an exploded side elevational view of a multi-piece trim for a recessed lighting fixture according to the present invention.
Figure 2:
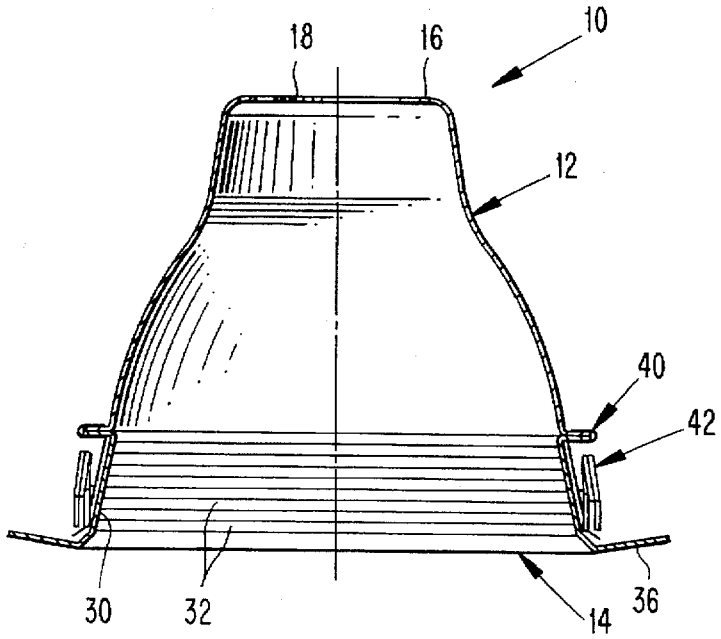
FIG. 2 is a vertical sectional view taken through a body of the trim depicted in FIG. 1.

A multi-piece trim 10 of the reflector/baffle type is depicted in FIGS. 1–3. That trim 10 comprises an upper reflector piece 12 and a separate lower rim or baffle piece 14 together forming a trim body. The reflector piece includes a top wall 16 having a through-hole 18 with diametrically opposed slots 20 for receiving a standard snap-in lamp socket 21. A lower end of the reflector piece is bent to form a laterally outwardly projecting annular flange 22 (see FIG. 5).

The baffle piece 14 comprises a frusto-conical portion 30 having annular steps 32 formed on an inner surface (preferably black) thereof, a laterally outwardly projecting annular flange 34 formed at its upper end, and a laterally outwardly projecting annular trim ring 36 formed at its lower end or rim.

The flanges 22, 34 of the reflector and baffle pieces 12, 14, respectively, are of the same outer diameter, and a lower surface of the flange 22 is adapted to contact an upper surface of the flange 34 as shown in FIG. 5.

Spring clips 40 of identical construction are provided for securing the reflector and baffle pieces 12, 14 together and for carrying torsion springs 70. Each spring clip 40 comprises an upper clamping portion 42 and a downwardly extending carrier portion 44. The clamping portion 42 includes generally horizontal upper and lower clamping legs 46, 48. Outer ends of respective legs 46, 48 are interconnected by a bight 50 which enables a free end 52 of the upper leg 46 to be elastically flexed away from the lower leg 48 in order to enable the flanges 22, 34 of the reflector and baffle portions 12, 14 to be inserted into a slot 54 formed between the legs 46, 48 and held frictionally therebetween. The upper leg 46 is provided with a V-shaped slit to form an elastic V-barb 56 which extends into the slot and has a point directed generally toward the bight 50. The barb engages the top surface of the flange 22 of the reflector piece 12 to resist dislodgement of the spring clip.

The carrier portion 44 depends downwardly from (i.e., is bent downwardly from) an end 58 of the lower leg 48 and bears elastically against an outer surface of the baffle piece 14.

Between its upper and lower ends, the carrier portion 44 includes two parallel vertical slits which form a vertical strip 60 that is bent outwardly to create a through-hole 62 which receives a spring leg 64 of a torsion spring 70 (see FIG. 4). The leg 64 is inserted through the hole 62 until the strip 60 becomes frictionally gripped between the leg 64 and a coil portion 72 of the spring.

With the flanges 46, 48 of the reflector and baffle pieces 12, 14 held together by a plurality (preferably two) of the spring clips 40, and with torsion springs 70 attached to respective spring clips, the trim can be installed by flexing the legs 64 of the torsion springs 70 upwardly, inserting the trim upwardly through a hole in a ceiling, and then connecting bent free ends 80 of the spring legs 64 to tabs 82 formed in a housing or "can" 84 (see FIG. 1).

In the case of a single-piece trim, that trim could be manufactured in a way that produces an integral flange structure projecting outwardly, and to which torsion springs can be mounted, preferably by clips (see FIG. 6).

It will be appreciated that the present invention enables torsion springs to be mounted to a trim and/or enables upper and lower trim pieces of a multi-piece trim to be interconnected, without diminishing the aesthetic appearance of the inner surface of the trim. Also, the present invention provides a novel spring clip which performs the dual functions of securing together two pieces of a multi-piece trim, and carrying a torsion spring for mounting a multi-piece or single-piece trim to a housing.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A trim for a recessed light fixture, comprising a trim body including an upper reflector portion, a lower rim, and a flange structure projecting outwardly from an outer surface of the trim body at a location above the lower rim; spring-mounting elements mounted on the flange structure, and torsion springs affixed to respective ones of the spring-mounting elements.

2. The trim according to claim 1 wherein the trim body includes the reflector portion and a baffle portion mounted as a separate piece to a lower end of the baffle portion, the flange structure comprising flanges on both the reflector and baffle portions, each spring-mounting element comprising a clip holding together the flanges of the reflector and baffle portions.

3. A trim for a recessed light fixture, comprising separate upper and lower trim pieces, each of the trim pieces including a flange structure projecting outwardly from an outer surface thereof; and fastening clips securing the flange structure of the upper trim piece to the flange structure of the lower trim piece.

4. A trim for a recessed light fixture, comprising:

an upper trim piece including a laterally outwardly projecting first flange at its lower end;

a lower trim piece including a laterally outwardly projecting second flange at its upper end, and a laterally outwardly projecting trim ring at its lower end, an upper surface of the second flange contacting a lower surface of the first flange;

a plurality of spring clips interconnecting the upper and lower trim pieces, each spring clip including a clamping portion for clamping the first and second flanges together, and a carrier portion; and a torsion spring connected to the carrier portion of each spring clip.

5. The trim according to claim 4 wherein the clamping portion comprises vertically spaced upper and lower horizontal clamping legs joined by a bight to be elastically movable away from one another for receiving the first and second flanges therebetween and frictionally clamping those flanges together.

6. The trim according to claim 5 wherein the carrier portion extends generally vertically from the clamping portion.

7. The trim according to claim 6 wherein the carrier portion extends downwardly from an end of the lower clamping leg disposed opposite the bight.

8. The trim according to claim 7 wherein the carrier portion includes a pair of vertical parallel slits forming a strip bent outwardly to form a through-hole, a respective torsion spring including a coil portion and a pair of spring legs extending in generally opposite directions from the coil portion, each torsion spring mounted to a respective strip by frictionally gripping the strip between its coil portion and one of its spring legs.

9. The trim according to claim 8 wherein one of the clamping legs includes a barb engaging a respective flange.

10. The trim according to claim 5 wherein the carrier portion includes a pair of vertical parallel slits forming a strip bent outwardly to form a through-hole, a respective torsion spring including a coil portion and a pair of spring legs extending in generally opposite directions from the coil portion, each torsion spring mounted to a respective strip by frictionally gripping the strip between its coil portion and one of its spring legs.

11. The trim according to claim 5 wherein one of the clamping legs includes a barb engaging a respective flange.

12. The trim according to claim 4 wherein the upper trim piece is a reflector, and the lower trim piece is a baffle, the upper trim piece including a top wall having an aperture formed therein, and a lamp socket mounted in the aperture.

13. A spring clip for securing together upper and lower trim pieces of a trim for a recessed light fixture, the spring clip comprising:

a pair of spaced apart, generally parallel clamping legs interconnected by a bight at respective ends thereof so that the spring legs are elastically movable away from one another;

a carrier portion bent laterally from an end of one of the spring legs located opposite the bight, the carrier portion including a bent-out strip forming a through-hole; and a torsion spring mounted to the strip, the torsion spring having a coil portion and a pair of spring legs extending in generally opposite directions from the coil portion, the strip being frictionally held between the coil portion and one of the spring legs.

14. The spring clip according to claim 13 wherein one of the clamping legs includes a barb projecting toward the other clamping leg and including a point directed generally toward the bight.

15. The spring clip according to claim 13 wherein the strip is formed by a pair of parallel slits in the carrier portion.

* * * * *